United States Patent [19]

Thewlis

[11] Patent Number: 4,538,870

[45] Date of Patent: Sep. 3, 1985

[54] ELECTRICAL CONNECTORS

[75] Inventor: Alan Thewlis, Moorside, Great Britain

[73] Assignee: International Computers Limited, London, England

[21] Appl. No.: 597,681

[22] Filed: Apr. 6, 1984

[30] Foreign Application Priority Data

Apr. 7, 1983 [GB] United Kingdom ..... 8309402

[51] Int. Cl.[3] ..... H01R 13/629

[52] U.S. Cl. ..... 339/75 M; 339/176 M

[58] Field of Search ..... 339/110 P, 75 M, 75 MP, 339/74 R, 17 CF, 176 M

[56] References Cited

U.S. PATENT DOCUMENTS

| | | | |
|---|---|---|---|
| 3,676,832 | 7/1972 | Judge et al. | 339/75 M |
| 4,034,284 | 7/1977 | Peplow et al. | 339/110 P |
| 4,381,130 | 4/1983 | Sprenkle | 339/74 R |
| 4,420,205 | 12/1983 | Kirkman | 339/17 CF |
| 4,468,076 | 8/1984 | Hine et al. | 339/75 M |
| 4,498,725 | 2/1985 | Bright et al. | 339/75 M |

FOREIGN PATENT DOCUMENTS

| | | | |
|---|---|---|---|
| 3008841 | 9/1980 | Fed. Rep. of Germany | 339/75 M |

OTHER PUBLICATIONS

IBM Technical Disclosure Bulletin, vol. 13, No. 9, Feb. 1971, "Area Array Connector" Hoffman et al.

IBM Technical Disclosure Bulletin, vol. 18, No. 10, Mar. 1976, "Enhanced Zero Insertion Connector" Meeker.

*Primary Examiner*—John McQuade

*Attorney, Agent, or Firm*—Lee, Smith & Zickert

[57] ABSTRACT

An electrical connector for a multi-pin circuit module in which the circuit module (6) is supported on a carrier (7) slidably mounted on a base unit (2) with its connection pins (10) extending through holes (9) in the carrier (7). Sliding the carrier (7) causes the pins (10) to engage contact elements (4) on the base unit (2) and the arrangement is such that each pin (10) is supported by the carrier (7) in the region of engagement.

4 Claims, 3 Drawing Figures

ELECTRICAL CONNECTORS

BACKGROUND OF THE INVENTION

The present invention relates to electrical connectors for multi-pin circuit modules such as pin grid array circuit packages.

Such circuit packages contain integrated circuit chips and have a high density array of small diameter connection pins extending from a face of the package. Insertion of the connection pins into a conventional multi-way connector socket to facilitate connection of the circuit package to a printed circuit board, for example, presents problems in that the relatively high force required to engage such a large number of pins simultaneously may damage the pins and/or the circuit package.

Various devices, generally known as zero insertion force connectors, have previously been proposed. Usually these devices employ a principle by which two multi-way connector elements are brought together so that corresponding contacts are moved axially into positions adjacent one another. Relative sideways movement is then introduced between the connector elements to bring the contacts into electrical engagement.

However, a disadvantage with such an arrangement when used with a pin grid array circuit package is that the sideways force which needs to be applied to the circuit package to urge the connection pins into good electrical contact with the connector elements is still relatively high and can again bend the connection pins or damage the circuit package.

SUMMARY OF THE INVENTION

According to the present invention an electrical connector for a multi-pin circuit module having an array of connection pins extending from one face includes;

a carrier plate of insulating material having a plurality of holes therein corresponding one with each of the connection pins and arranged so that when the circuit module is supported thereon the connection pins extend through the holes;

an insulating base member carrying a plurality of contact elements corresponding one with each of the connection pins, the carrier plate being slidably mounted on the base member; and means operable to cause the carrier plate to slide so that the connection pins are urged by the carrier plate into engagement with their corresponding contact elements, the carrier plate and the contact elements being arranged so that a portion of the carrier plate supports the pins in the region of the engagement between the pins and the contact elements.

BRIEF DESCRIPTION OF THE DRAWINGS

An electrical connector for multi-pin integrated circuit packages will now be described by way of example, with reference to the accompanying drawings, in which.

DESCRIPTION OF THE PREFERRED EMBOIDIMENT

Figure 1:
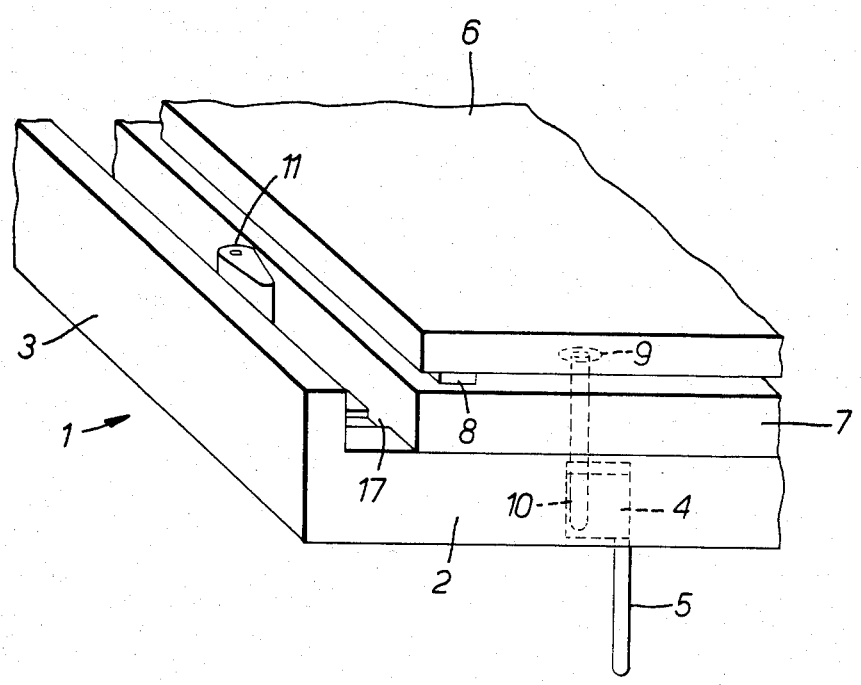
FIG. 1 shows a perspective view of part of the connector and a package.

Referring to FIG. 1 of the drawings, an electrical connector 1 comprises a base unit 2 having an upturned portion 3 extending along one of its edges. The base unit 2 houses contact elements 4, (one element only is shown in broken lines), which extend through the underside of the base unit 2 to form connection pins 5 which may be connected into plated-through holes in a printed circuit board. The base unit 2 is formed from an insulating material and may, for example, be a plastics moulding.

A multi-pin integrated circuit package 6 is supported on a carrier 7. Projections 8 on the carrier 7 space the circuit package 6 away from the surface of the carrier 7. The carrier 7 is slidably mounted on the base unit 2 and has a pattern of holes 9 extending therethrough which corresponds to the pattern of connection pins 10 of the circuit package 6. The holes 9 are chamfered at the face of the carrier 7 on which the circuit package is supported to facilitate the entry of the connection pins 10 which extend through the holes 9 and are engageable with corresponding ones of the contact elements 4. A manually rotatable cam 11 is located between the upturned portion 3 of the base unit 2 and the carrier 7 and is arranged so that upon rotation, the carrier 7 is moved in a direction away from the upturned portion 3 to cause the connection pins 10 to engage the contact elements 4. Further cam means (not shown) are provided to move the carrier 7 back in the opposite direction to cause the connection pins 10 to be disengaged. The carrier 7 is also formed from an insulating material and, as in the case of the base unit 2, may be a plastics moulding.

Figure 2:
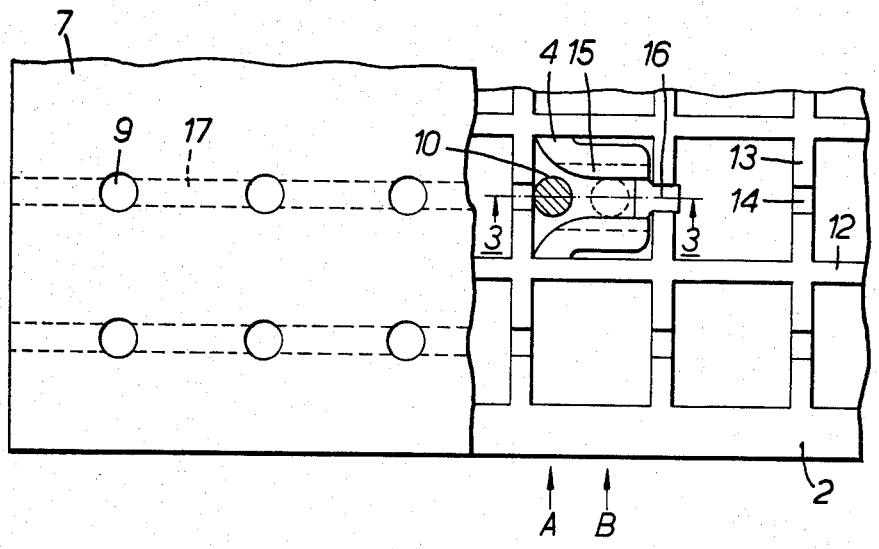
FIG. 2 shows a cut-away plan view of part of the connector.
Figure 3:
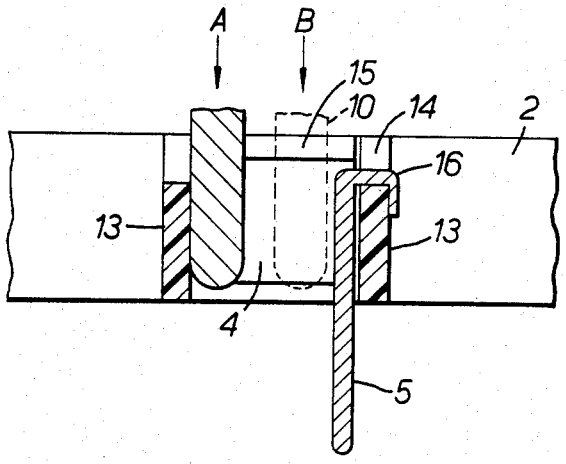
FIG. 3 is a section along the line 3—3 of FIG. 2.

Referring now to FIGS. 2 and 3, which show the structure of the base unit 2 and the carrier 7 in more detail, it will be seen that the base unit 2 consists of a matrix of ribs 12 and 13. Rows of aligned cut out portions 14 are provided in the ribs 13 as shown. The contact elements 4 are housed one in each of the cells and are substantially U-shaped in plan view to receive the connection pins 10. A connection pin 10 is shown in FIGS. 2 and 3 in the disengaged position indicated by arrows A and in broken lines in the engaged position indicated by arrows B. The upper edges of each contact element 4 are turned inwardly towards one another, as indicated at 15, so as to engage the connection pins only at a point adjacent the upper face of the base unit 2. Portions 16 of the contact elements 4 clip into the bottoms of the cut out portions 14 in the ribs 13 to secure the contact elements 4 in position.

Parallel ridges 17, (shown in FIG. 1 and in broken lines in FIG. 2), are formed on the underside of the carrier 7 and enter into the cut out portions 14 when the carrier 7 is in position on the base unit 2. The ridges 17 in conjunction with the cut out portions 14 are effective to locate and guide the carrier 7 throughout its movement. It will be noted that the holes 9, in which the connection pins 10 are a sliding fit, are formed through the ridges 17. The thickness of the ridges 17 is less than the diameter of the holes 9 and is also less than the space between the turned over portions 15 of the contact elements 4.

In use, the circuit package 6 is first of all assembled on to the carrier 7 by inserting the connection pins 10 into their respective holes 9 and lowering the circuit package 6 until it rests on the projections 8. The projections 8 are situated at the corners of the circuit package 6 and also at its centre and are effective both to relieve stresses on the connection pins 10 and to improve heat dissipation by increasing air circulation. When the circuit package 6 is resting on the projections 8 the ends of the connection pins 10 protrude through the carrier 7 as shown in FIGS. 1 and 3.

The carrier 7 is next positioned on the base unit 2 so that the ridges 17 fit into the cut out portions 14 in the ribs 13 and the connection pins 10 extend into the base unit 2. It will be realised that the carrier 7 must be positioned so that the connection pins 10 are not in engagement with the contact elements 4. In order to achieve this the cam 10 must be rotated to allow the carrier 7 to be positioned at the extremity of its movement towards the upturned portion 3. In this condition each of the connection pins 10 is positioned relative to its corresponding contact element 4 in the direction of movement as indicated by the arrows A in FIGS. 2 and 3.

Finally, the cam 10 is rotated to move the carrier 7 away from the upturned portion 3 to bring each of the connection pins 10 into a position of engagement with its corresponding contact element 4. This position is indicated by the arrows B in FIGS. 2 and 3.

It will be noted that the turned over portions 15 of the connector elements 4 engage the connection pins 10 in line with the ridges 17, thus the ridges 17 provide support for the connection pins 10 to protect them from bending forces when the pins are engaged with the contact elements. The design of the connector elements 4 is such that the contact pressure between the connector elements and the connection pins 10 is determined solely by the elasticity of the connector elements and is not dependent upon other factors such as tolerances in the base unit moulding, for example. The design also ensures that, once the pins 10 are engaged with the connector elements 4, no force is required to maintain this engagement. Thus, no strain or distortion derived from any such force is applied to the assembly.

It has been found that the carrier 7, in addition to protecting the circuit package 6 from damage during connection and disconnection from the base unit 2, provides a useful means for protecting the circuit package during such handling as is necessary for assembly and test functions, for example. Thus, the circuit package may be assembled on to the carrier at an early stage and can remain in situ thereafter.

Although not illustrated in the figures, it has been found advantageous to provide serrated finger grip areas on the carrier to facilitate the removal of the carrier from the base unit.

The air circulation beneath the circuit may be increased if desired by means of slots provided in the sides of the carrier.

It will be realised that, if desired, the cam 10 may be replaced by a wedge or a threaded screw engaging the carrier and co-operating with a threaded member on the base unit.

The contact elements are manufactured from a material such as phosphor bronze, for example, and it has been found that gold plating the contacts, as is the usual practice, can in some instances be dispensed with due to the high contact pressures which are in the order of $\frac{1}{2}$ to 1 Kg. The device thus provides high reliability at lower cost.

It is important that the conductive path from the circuit package to the connection pins 5 of the base unit is kept as short as possible to minimise inductive effects. The device of the present application achieves this by the matrix design of the base unit, reducing the thickness of the carrier 7 as much as possible and by spacing the circuit package a minimum distance from the carrier consistent with the requirement for air circulation between the circuit package and the carrier.

I claim:

1. An electrical connector for a multi-pin circuit module having an array of connection pins extending from one face including:

a carrier plate of insulating material having a plurality of ridges on one surface, the ridges having a width between opposite edges which is less than the diameter of the connection pins, the carrier plate also having a plurality of holes corresponding one with each of the connection pins and extending through the plate and the ridges so that when the circuit module is supported on the carrier plate the connection pins extend through the holes with portions exposed at the opposite edges of the ridges;

an insulating base member carrying a plurality of contact elements corresponding one with each of the connection pins and having inwardly facing turned over portions for engaging the contact pins therebetween;

means for slidably mounting the carrier plate on the insulating base member so that the ridges extend between the turned over portions of the contact elements; and means operable to cause the carrier plate to slide so that the said exposed portions of the connection pins engage the turned over portions of their corresponding contact elements.

2. An electrical connector as claimed in claim 1, in which the contact elements are substantially U-shaped and are arranged to grip the connection pins with a predetermined pressure.

3. An electrical connector as claimed in claim 1, in which said means operable to cause the carrier plate to slide includes a cam.

4. An electrical connector as claimed in claim 1 in which the means for slidably mounting the carrier plate is provided by the ridges engaging complementary recesses in the base member.

* * * * *